US008210246B2

(12) United States Patent
Bhatti et al.

(10) Patent No.: US 8,210,246 B2
(45) Date of Patent: Jul. 3, 2012

(54) HIGH PERFORMANCE THREE-FLUID VEHICLE HEATER

(75) Inventors: Mohinder Singh Bhatti, Williamsville, NY (US); Mark James Zima, Clarence Center, NY (US); Prasad Shripad Kadle, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 1120 days.

(21) Appl. No.: 12/075,367

(22) Filed: Mar. 11, 2008

(65) Prior Publication Data

US 2009/0229800 A1 Sep. 17, 2009

(51) Int. Cl.
*F28D 7/10* (2006.01)

(52) U.S. Cl. ..... 165/140; 165/165; 165/174; 165/175

(58) Field of Classification Search ..... 165/140, 165/165, 174, 175
See application file for complete search history.

(56) References Cited

U.S. PATENT DOCUMENTS 2,382,255 A * 8/1945 Pyzel ..... 165/140
2,658,357 A * 11/1953 Smith ..... 62/278
6,935,414 B2 * 8/2005 Kawakubo et al. ..... 165/164
7,111,669 B2 * 9/2006 Hoglinger et al. ..... 165/140

* cited by examiner

*Primary Examiner* — Teresa Walberg
(74) *Attorney, Agent, or Firm* — James M. Chan

(57) ABSTRACT

A heat exchanger assembly includes a pair of outer headers each defining an outer cavity and a pair of inner headers each defining an inner cavity. Each inner header is disposed in one of the outer headers, and each header defines a plurality of header slots. A plurality of first fluid tubes extend between the outer headers from one of the header slots of each outer header to fluidly interconnect the outer cavities defined by the outer headers and a plurality of second fluid tubes are interleaved with the first refrigerant tubes and extend between the outer headers and through one of the header slots of each outer header and through the associated outer cavities defined by the outer headers and to the one of the header slots of each inner header to fluidly interconnect the inner cavities defined by the inner headers.

12 Claims, 3 Drawing Sheets

HIGH PERFORMANCE THREE-FLUID VEHICLE HEATER

BACKGROUND OF THE INVENTION

1. Field of the Invention

The subject invention relates generally to a heat exchanger, and, more specifically, to a heat exchanger of the type including a plurality of fluid tubes extending between an inlet header and an outlet header for transferring fluid from the inlet header to the outlet header.

2. Description of the Prior Art

Heating systems for automobiles have traditionally relied upon engine coolant as the sole heat source for providing comfort heating to the occupants of a vehicle. In such heating systems, a heat exchanger is generally used to transfer heat from the engine coolant to a second fluid, generally air. An example of such a heat exchanger is disclosed in U.S. Pat. No. 1,684,083 to S. C. Bloom.

The Bloom patent discloses a pair of headers each extending between a pair of header ends and defining a cavity. Each of the headers defines a plurality of header slots spaced from one another between the header ends thereof. A plurality of fluid tubes each extend between the headers from one of the header slots of each header to fluidly interconnect the cavities defined by the headers. A first fluid, generally an engine coolant, may flow through one of the cavities defined by one of the headers and through the fluid tubes and through the other of the cavities defined by the other of the headers, and a second fluid, generally air, may flow across the fluid tubes for transferring heat from the first fluid to the second fluid.

The heating capacity of a heat exchanger as disclosed by the Bloom patent is generally limited by the temperature of the engine coolant. Accordingly, with the advent of more efficient internal combustion engines, the amount of heat available from the engine coolant for comfort heating is reduced. As a result, three-fluid heat exchangers have been developed to add another heat source to increase the amount of heat available for comfort heating. Examples of such three-fluid heat exchangers are disclosed in U.S. Pat. No. 4,002,201 to Donaldson and U.S. Pat. No. 5,884,696 to Loup.

The Loup patent discloses a pair of first headers each extending between a pair of first header ends and defining a first cavity. Each of the first headers are disposed in a spaced relationship to one another. A pair of second headers each extending between a pair of second header ends and defining a second cavity are each disposed adjacent one of the first headers. Each of the headers defines a plurality of header slots spaced from one another between the header ends thereof. A plurality of first fluid tubes each extend between the first headers from one of the header slots of each first header to fluidly interconnect the first cavities defined by the first headers. A plurality of second fluid tubes each extend between the second headers and adjacent the first fluid tubes from one of the header slots of each second header to fluidly interconnect the second cavities defined by the second headers. A first fluid may flow through one of the first cavities defined by the associated first header and through the first fluid tubes and through the other first cavity defined by the other first header, a second fluid may flow through one of the second cavities defined by the associated second header and through the second fluid tubes and through the other second cavity defined by the other second header, and a third fluid may flow across the fluid tubes for transferring heat from the first and second fluids to the third fluid.

The Donaldson patent discloses a heat exchanger similar to that as disclosed by the Loup patent except wherein the second fluid tubes are interleaved with the first fluid tubes.

The three-fluid heat exchangers as disclosed by the Loup patent and the Donaldson patent provide for an increased amount of heat for comfort heating by transferring heat from a first and second fluid to a third fluid, however, such patents essentially comprise two heat exchangers functioning independently of one another which are placed adjacent one another thereby increasing the size of the heat exchanger. Accordingly, there remains a need for a heat exchanger which provides an increased amount of heat but which does not have an increased size.

SUMMARY OF THE INVENTION AND ADVANTAGES

The invention provides such a heat exchanger assembly wherein the first headers are outer headers each defining an outer cavity and the second headers are inner headers each defining an inner cavity. Each inner header is disposed in one of the outer headers, and the heat exchanger assembly is improved by each second fluid tube extending through one of the header slots of each outer header and through the associated outer cavity and to one of the header slots of each inner header to fluidly interconnect the inner cavities defined by the inner headers whereby a first fluid may flow through one of the outer cavities defined by the associated outer header and through the first fluid tubes and through the other of the outer cavities defined by the other of the outer headers and a second fluid may flow through one of the inner cavities defined by the associated inner header and surrounded by the associated outer header and through the second fluid tubes and through the other of the inner cavities defined by the other of the inner headers and surrounded by the other of the outer headers and a third fluid may flow across the fluid tubes for transferring heat from the first and second fluids to the third fluid.

Accordingly, the present invention provides an improved heat exchanger for transferring heat by increasing the amount of available heat by providing for a three-fluid heat exchanger and by decreasing the overall size of the heat exchanger by providing for a single core construction.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
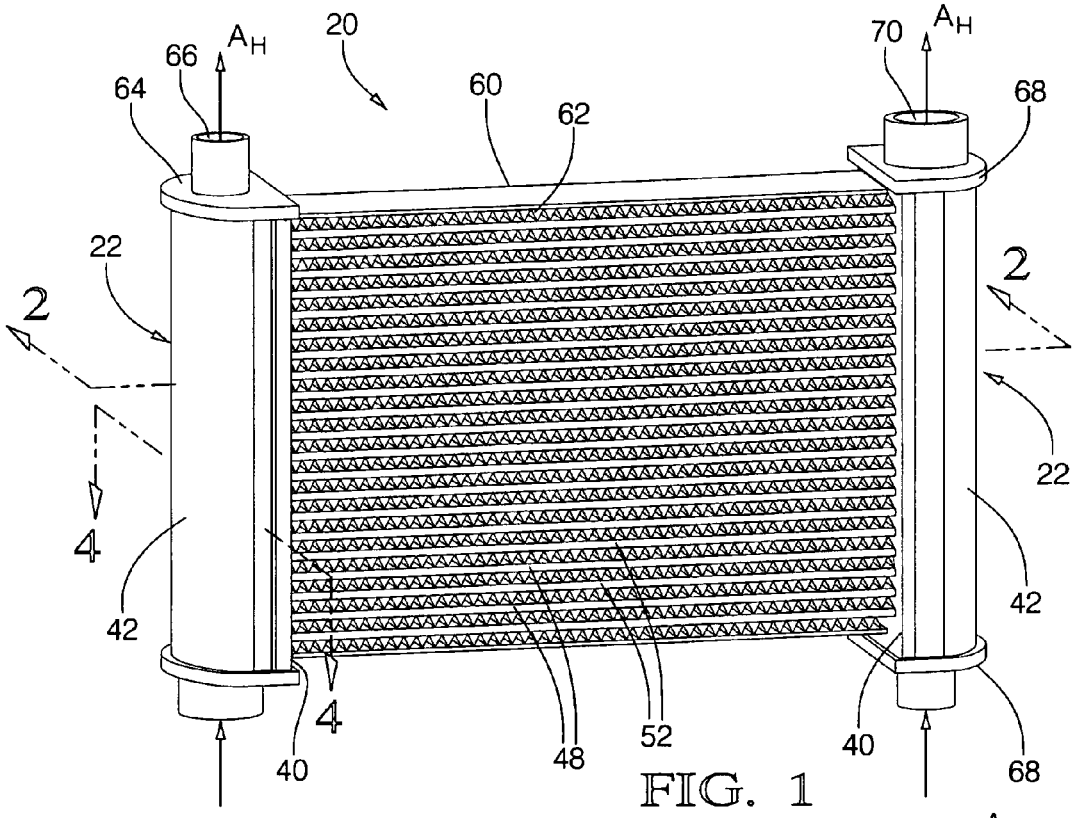
FIG. 1 is a perspective view of the heat exchanger assembly.

Referring to the Figures, wherein like numerals indicate corresponding parts throughout the several views, a heat exchanger assembly 20 for transferring heat is shown generally in FIG. 1.

Figure 4:
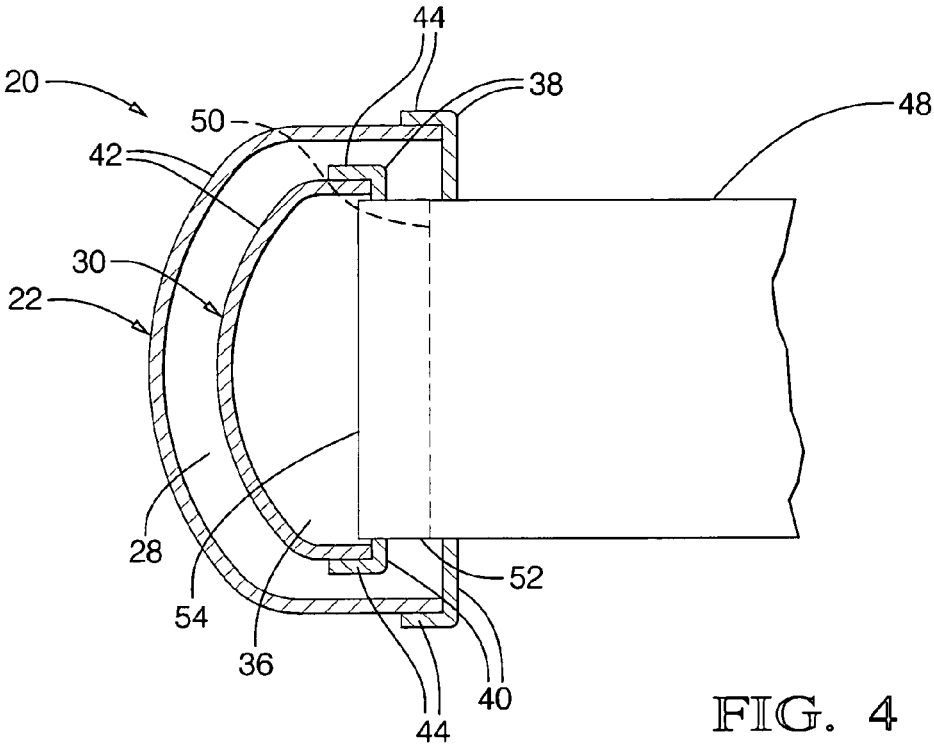
FIG. 4 is a cross-sectional, fragmentary, and side view of the heat exchanger assembly as shown in FIG. 1 horizontally along 4-4 showing an inner and outer header each having a generally semi-circular cross-section and including a curved wall arched upwardly between a pair of sides of a lanced wall.

The heat exchanger assembly 20 comprises a pair of outer headers 22 each extending between a first outer header end 24 and a second outer header end 26. One of the outer headers 22 is for receiving a first fluid, and the other of the outer headers 22 is for exiting the first fluid from the assembly 20. In an embodiment of the assembly 20 as shown in FIG. 4, each outer header 22 is generally semi-circular in cross-section to define an outer cavity 28. However, those skilled in the art appreciate that additional embodiments of the heat exchanger assembly 20 include outer headers 22 having various other cross-sections to define the outer cavities 28.

Each of the outer headers 22 is disposed in a spaced relationship to one another and extends along a respective header axis $A_H$. In the embodiment of the assembly 20 as shown in FIG. 1, the outer headers 22 are disposed in a parallel relationship to one another with the header axes $A_H$ being parallel to one another.

A pair of inner headers 30 each extend between a first inner header end 32 and a second inner header end 34. One of the inner cavities 36 is for receiving a second fluid, and the other of the inner cavities 36 is for exiting the second fluid from the assembly 20. In an embodiment of the assembly 20 as shown in FIG. 4, each inner header 30 is generally semi-circular in cross-section to define an inner cavity 36. However, those skilled in the art appreciate that additional embodiments of the heat exchanger assembly 20 include inner headers 30 having various other cross-sections to define the inner cavities 36.

Figure 2:
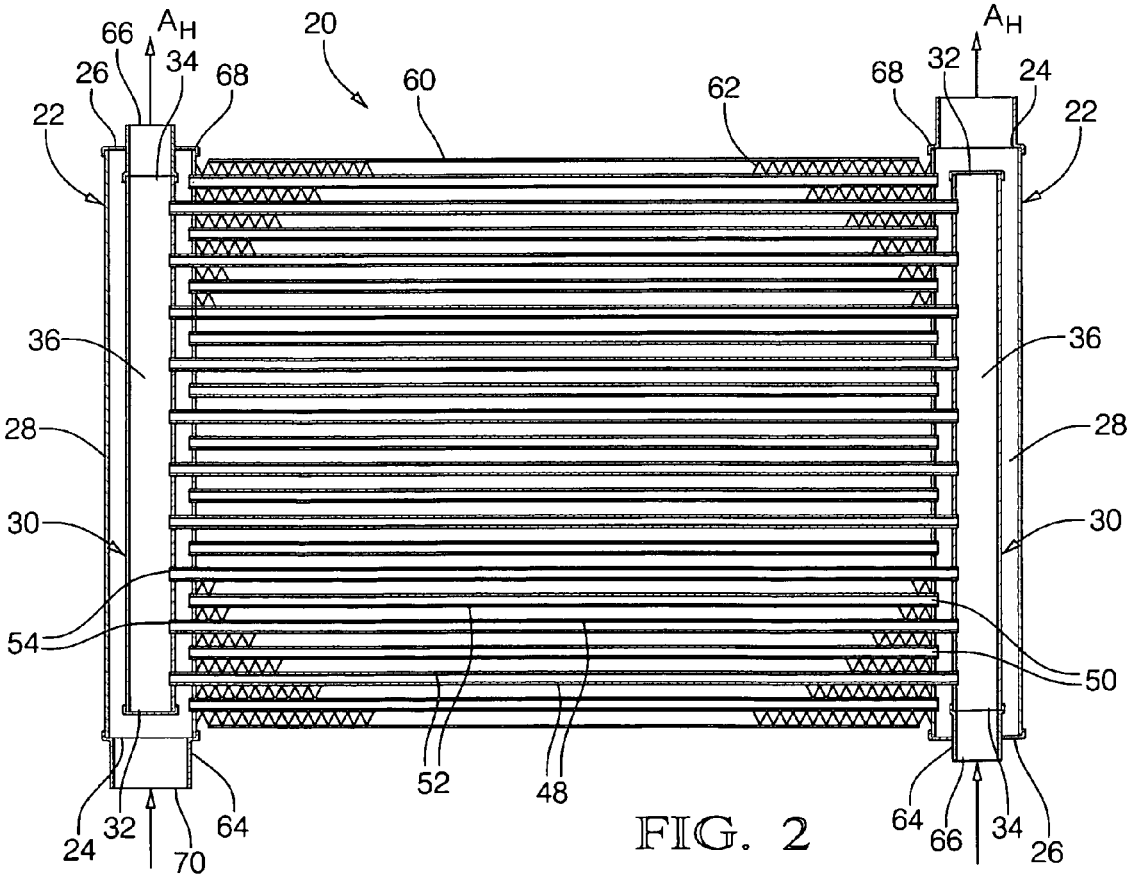
FIG. 2 is a cross-sectional, front view of the heat exchanger assembly shown in FIG. 1 vertically along 2-2.

Each inner header 30 is disposed in one of the outer headers 22 and extends along the associated header axis $A_H$ between the associated outer header ends 24, 26. In an embodiment of the assembly 20 as shown in FIG. 2, each inner header 30 extends coaxial to the associated outer header 22 between the associated outer header ends 24, 26. The first inner header end 32 of each inner header 30 is preferably adjacent the first outer header end 24 of the associated outer header 22 and the second inner header end 34 of each inner header 30 is preferably adjacent the second outer header end 26 of the associated header. Additionally, as shown in FIG. 2, the headers 22, 30 preferably extend along the header axes $A_H$ in opposite directions between the first and second header ends 24, 26, 32, 34 thereof to align the input for the outer headers 22 and the input for the inner headers 30 on the same side 38 of the heat exchanger assembly 20 as shown in FIG. 2.

In the embodiment of the assembly 20 as shown in FIG. 4, the cross-section of each of the headers 22, 30 includes a lanced wall 40 extending between a pair of sides 38 and a curved wall 42 arched upwardly between the sides 38 to define the headers 22, 30 as being generally semi-circular in cross-section. Each lanced wall 40 includes a pair of flanges 44 each extending along one of the sides 38 of the lanced wall 40 with the flanges 44 in an overlapping relationship with the associated curved wall 42. Each of the lanced walls 40 defines a plurality of header slots 46 spaced from one another between the header ends 24, 26, 32, 34 thereof. The header slots 46 are preferably axially spaced on the headers 22, 30 along the header axes $A_H$ as shown in FIG. 2.

Each of the header slots 46 is preferably elongated and extends transversely to the header axes $A_H$. The headers 22, 30 are preferably punctured with a lance to define the header slots 46 to prevent the production of slugs, to provide easier bonding, and to add reinforcement, However, in additional embodiments of the assembly 20, the headers 22, 30 can be drilled, punched, or created by any other method known in the art to define the header slots 46.

A plurality of first fluid tubes 48 each extend between a pair of first fluid tube ends 50 and transversely to the header axes $A_H$ between the outer headers 22. The first fluid tubes 48 are preferably in a spaced and parallel relationship with one another as shown in FIG. 1. Each first fluid tube 48 extends from one of the header slots 46 of each outer header 22 to fluidly interconnect the outer cavities 28 defined by the outer headers 22. In an embodiment of the assembly 20 as shown in FIG. 2, the first fluid tube ends 50 of each first fluid tube 48 extend through one of the header slots 46 of each outer header 22 and into the outer cavity 28 thereof.

A plurality of second fluid tubes 52 each extend between a pair of second fluid tube ends 54 and transversely to the header axes $A_H$ between the outer headers 22. The second fluid tubes 52 are preferably in a spaced and parallel relationship with the first fluid tubes 48 as shown in FIG. 1. The second fluid tubes 52 are also preferably interleaved with the first fluid tubes 48 as shown in FIGS. 1 and 2.

Figure 3:
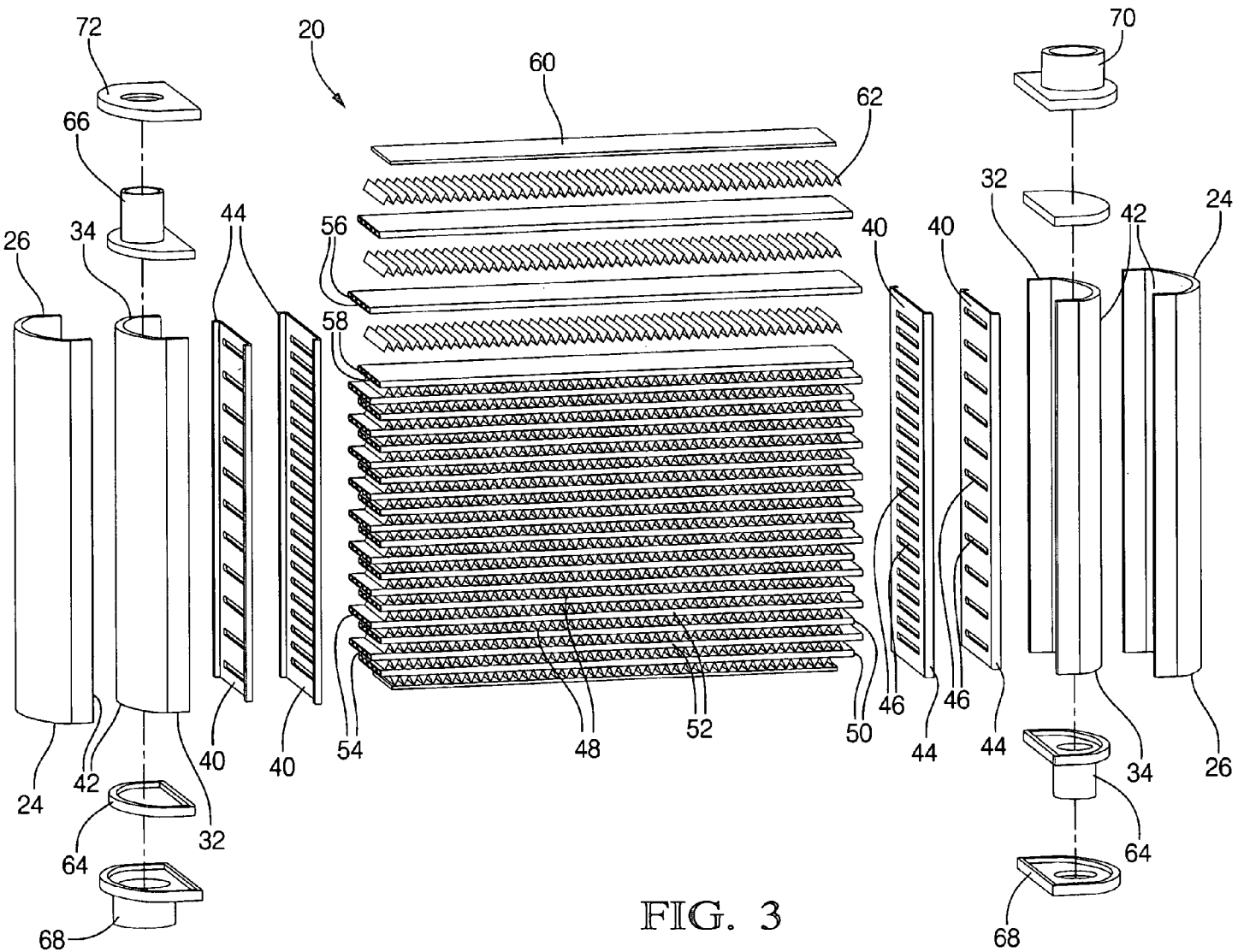
FIG. 3 is an exploded view of the heat exchanger assembly shown in FIG. 1.

Each of the fluid tubes 48, 52 preferably have a generally elongated cross-section for being received by the elongated header slots 46. Each of the fluid tubes 48, 52 also preferably include at least one divider 56 extending within the associated fluid tube 48, 52 along the length of the associated fluid tube 48, 52 for reinforcing the fluid tube and defining a plurality of fluid passages 58 extending between the fluid tube ends 50, 54 within the associated fluid tube 48, 52 as shown in FIG. 3.

As shown in FIG. 2, a pair of core reinforcements 60 extend between the outer headers 22 outwardly of the fluid tubes 48, 52 and interconnect the outer headers 22. The core reinforcements 60 preferably extend in a parallel and spaced relationship to the fluid tubes 48, 52.

A plurality of cooling fins 62 are disposed between adjacent fluid tubes 48, 52 and between the core reinforcements 60 and the next adjacent of the fluid tubes 48, 52 for dissipating heat from the fluid tubes 48, 52. In the Figures, the cooling fins 62 are shown as serpentine fins, however, those skilled in the art appreciate that other types of cooling fins 62 can be used in additional embodiments of the heat exchanger assembly 20.

A pair of inner end caps 64 are each hermetically sealed to one of the inner header ends 32, 34 of each inner header 30. The inner end caps 64 sealed about the inner header ends 32, 34 can be either internal or external end caps. The inner end cap 64 which is hermetically sealed to the second inner header end 34 of each inner header 30 defines an inner aperture 66 in fluid communication with the associated inner cavity 36. One of the inner apertures 66 is an inlet for the associated inner cavity 36 defined by the associated inner header 30 for receiving the second fluid, and the other of the inner apertures 66 is an outlet for the other of the inner cavities 36 defined by the other of the inner headers 30 for exiting the second fluid from the assembly 20.

A pair of outer end caps 68 are each hermetically sealed to one of the outer header ends 24, 26 of each outer header 22. The outer end caps 68 sealed about the outer header ends 24, 26 can be either internal or external end caps. The outer end cap 68 which is hermetically sealed to the first outer header end 24 of each outer header 22 defines an outer aperture 70 in fluid communication with the associated outer cavity 28. One of the outer apertures 70 is an inlet for the associated outer cavity 28 defined by the associated outer header 22 for receiving the first fluid, and the other of the outer apertures 70 is an outlet for the other of the outer cavities 28 defined by the other of the outer headers 22 for exiting the first fluid form the assembly 20.

The heat exchanger assembly 20 is distinguished by each of the second fluid tubes 52 extending through one of the header slots 46 of each outer header 22 and through the associated outer cavity 28 and to one of the header slots 46 of each inner header 30 to fluidly interconnect the inner cavities 36 defined by the inner headers 30. In an embodiment of the assembly 20 as shown in FIG. 2, the second fluid tube ends 54 of each second fluid tube 52 extend through one of the header slots 46 of each outer header 22 and through the associated outer cavity 28 and through one of the header slots 46 of each inner header 30 and into the associated inner cavity 36.

The assembly 20 is further distinguished by the outer end cap 68 which is hermetically sealed to the second outer header end 26 of each outer header 22 defining a receiving aperture 72 aligned and in fluid communication with the inner aperture 66 of the inner end cap 64 hermetically sealed to the second inner header end 34 of the associated inner header 30.

In operation, a first fluid may flow through one of the outer apertures 70 and through the associated outer cavity 28 defined by the associated outer header 22 and through the first fluid tubes 48 and through the other of the outer cavities 28 defined by the other of the outer headers 22 and through the other of the outer apertures 70, and a second fluid may flow through one of the inner apertures 66 and through the associated inner cavity 36 defined by the associated inner header 30 and surrounded by the associated outer header 22 and through the second fluid tubes 52 and through the other of the inner cavities 36 defined by the other of the inner headers 30 and surrounded by the other of the outer headers 22 and through the other of the inner apertures 66. A third fluid may flow between the fluid tubes 48, 52 and across the cooling fins 62 for transferring heat from the first and second fluids to the third fluid.

Figure 5:
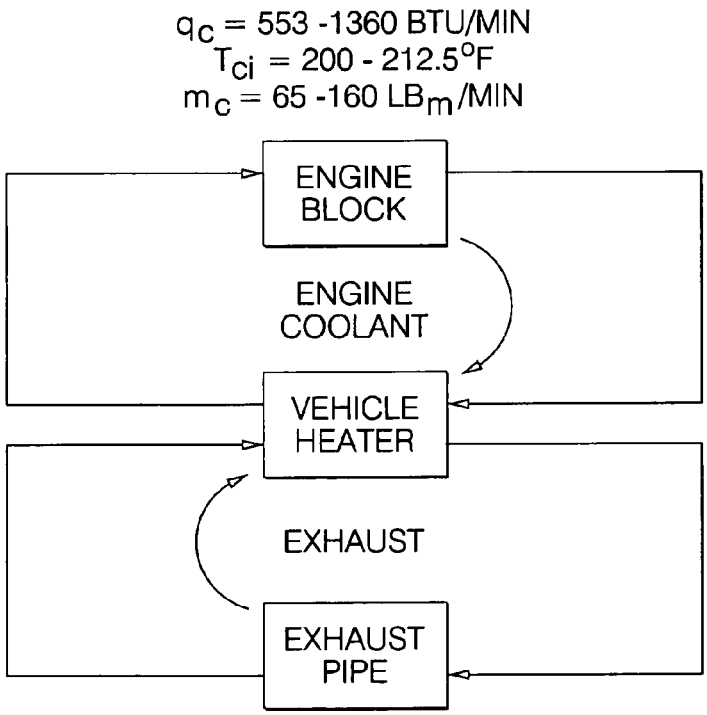
FIG. 5 is a schematic view of the first and second fluids of an embodiment of the heat exchanger assembly.

In the preferred embodiment, the heat exchanger assembly 20 is a vehicle heater 20 and draws its thermal energy from two sources in a fuel powered motor vehicle. One of the first and second fluids of the vehicle heater 20 is the engine coolant abstracting heat from the engine block, and the other of the first and second fluids is the exhaust gas abstracting heat from the combustion of fuel in the internal combustion engine and discharging it to the ambient air through the exhaust pipe as shown in FIG. 5. The engine coolant generally flows directly into the vehicle heater 20 while the exhaust gas, on the other hand, preferably does not flow into the vehicle heater 20 for safety reasons. The exhaust gas is preferably used to generate steam in a separate heat exchanger, and this steam flows into the vehicle heater 20.

In the preferred embodiment, as shown in FIG. 5, the rate of abstraction of heat from the engine coolant ($\dot{q}_c$) is generally 553-1360 Btu/min, the engine coolant inlet temperature into the vehicle heater 20 ($T_{ci}$) is generally 200-212.5° F., and the mass flow rate of the engine coolant ($\dot{m}_c$) is generally 65-160 $lb_m$/min. The rate of abstraction of heat by the exhaust gas from the combustion of fuel ($\dot{q}_e$) is generally 250-1600 Btu/min, the exhaust gas temperature in the exhaust pipe ($T_e$) is generally 1000-1600° F., and the mass flow rate of the exhaust gas in the exhaust pipe ($\dot{m}_e$) is generally 1-4 $lb_m$/min. Accordingly, depending on the amount of heat derived from the two heat sources in the motor vehicle, varying discharge air temperatures ($T_d$) can be attained in the vehicle heater 20. If $T_d$ is the desired discharge air temperature, then the fraction of the heat to be drawn by the vehicle heater 20 from the exhaust gas via steam (x) can be controlled with a valve and determined using the relation:

$$x = \frac{T_d - \varepsilon_c T_c - (1 - \varepsilon_c)T_a}{(\dot{m}_e c_{pe} / \dot{m}_a c_{pa})\varepsilon_e (T_e - T_s) - \varepsilon_c (T_c - T_a)} \quad (1)$$

wherein:

$T_d$ is the discharge air temperature of the vehicle heater 20;

$T_c$ is the incoming temperature of the coolant into the vehicle heater 20;

$T_a$ is the temperature of incoming air into the vehicle heater 20;

$\epsilon_c$ is the effectiveness of the coolant portion of the vehicle heater 20;

$\epsilon_e$ is the effectiveness of the exhaust gas portion of the vehicle heater 20;

$\dot{m}_a$ is the mass flow rate of air into the vehicle heater 20;

$\dot{m}_e$ is the mass flow rate of exhaust gas from the internal combustion engine;

$c_{pa}$ is the isobaric specific heat of air; and $c_{pe}$ is the isobaric specific heat of exhaust gas.

It therefore follows that when x=0, i.e., when the exhaust gas heat source is cut off, the following expression for the discharge air temperature is obtained from Eq. (1):

$$T_d = (1-\epsilon_c)T_a + \epsilon_c T_c \quad (2)$$

Additionally, when x=1, i.e., when the engine coolant heat source is cut off, the following expression for the discharge air temperature is obtained from Eq. (1):

$$T_d = T_a + \frac{\dot{m}_e c_{pe} \varepsilon_e (T_e - T_s)}{\dot{m}_a c_{pa}} \quad (3)$$

While the invention has been described with reference to an exemplary embodiment, it will be understood by those skilled in the art that various changes may be made and equivalents may be substituted for elements thereof without departing form the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly for heat transfer comprising;

a pair of outer headers each extending between a first outer header end and a second outer header end and defining an outer cavity, each of said outer headers disposed in spaced relationship to one another, a pair of inner headers each extending between a first inner header end and a second inner header end and defining an inner cavity, each inner header disposed in one of said outer headers, each of said headers defining a plurality of header slots axially spaced from one another between said header ends thereof, a plurality of first fluid tubes each extending between said outer headers from one of said header slots of each outer header to fluidly interconnect said outer cavities defined by said outer headers, a plurality of second fluid tubes each extending between said outer headers, and each of said second fluid tubes extending through one of said header slots of each outer header and through the associated outer cavity and to one of said header slots of each inner header to fluidly interconnect said inner cavities defined by said inner headers, a pair of inner end caps each hermetically sealed to one of said inner header ends of each inner header wherein said inner end cap hermetically sealed to said second inner header end of each inner header defines an inner aperture in fluid communication with the associated inner cavity, a pair of outer end caps each hermetically sealed to one of said outer header ends of each outer header wherein said outer end cap hermetically sealed to said first outer header end of each outer header defines an outer aperture in fluid communication with the associated outer cavity, whereby a first fluid flow through one of said outer cavities defined by the associated outer header and through said first fluid tubes and through the other of said outer cavities defined by the other of said outer headers and a second fluid flow through one of said inner cavities defined by the associated inner header and surrounded by the associated outer header and through said second fluid tubes and through the other of said inner cavities defined by the other of said inner headers and surrounded by the other of said outer headers and a third fluid flow across said fluid tubes for transferring heat from the first and second fluids to the third fluid, wherein said first fluid tubes extend in a spaced relationship with one another and wherein said second fluid tubes are interleaved with said first fluid tubes such that said second fluid tubes and said first fluid tubes are arranged in an alternating arrangement wherein said second fluid tubes includes opposing second fluid tube ends terminating in said inner cavities.

2. An assembly as set forth in claim 1 wherein said outer end cap hermetically sealed to said second outer header end portion of each outer header defines a receiving aperture aligned and in fluid communication with said inner aperture of said inner end cap hermetically sealed to said second inner header end of the associated inner header.

3. An assembly as set forth in claim 2 wherein said first inner header end of each inner header is adjacent said first outer header end of the associated outer header and said second inner header end of each inner header is adjacent said second outer header end of the associated header.

4. An assembly as set forth in claim 3 wherein each header extends along a respective header axis in opposite directions between said first and second header ends thereof.

5. An assembly as set forth in claim 1 wherein each of said inner headers extends coaxial to the associated outer header between the associated outer header ends.

6. An assembly as set forth in claim 1 wherein said outer headers extend in a parallel relationship to one another.

7. An assembly as set forth in claim 1 wherein each of said second fluid tubes extends through one of said header slots of each inner header and into the associated inner cavity.

8. An assembly as set forth in claim 7 wherein each of said first fluid tubes extends through one of said header slots of each outer header and into the associated outer cavity.

9. An assembly as set forth in claim 1 wherein each header is generally semi-circular in cross-section to define said cavities.

10. An assembly as set forth in claim 9 wherein the cross-section of each header includes a lanced wall extending between sides and a curved wall arched upwardly between said sides to define said headers as being generally semi-circular in cross-section.

11. An assembly as set forth in claim 10 wherein each lanced wall defines said header slots.

12. An assembly as set forth in claim 10 wherein each lanced wall includes a pair of flanges each extending along one of said sides with said flanges in an overlapping relationship with the associated curved wall.

* * * * *